US006558275B2

(12) United States Patent
Ohama

(10) Patent No.: US 6,558,275 B2
(45) Date of Patent: May 6, 2003

(54) THREE-PIECE SOLID GOLF BALL

(75) Inventor: Keiji Ohama, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 27 days.

(21) Appl. No.: 09/777,685

(22) Filed: Feb. 7, 2001

(65) Prior Publication Data

US 2001/0031669 A1 Oct. 18, 2001

(30) Foreign Application Priority Data

Feb. 8, 2000 (JP) ..... 2000/030412

(51) Int. Cl.[7] ..... A63B 37/04; A63B 37/06; A63B 37/00

(52) U.S. Cl. ..... 473/373; 473/371; 473/351

(58) Field of Search ..... 473/351–377

(56) References Cited

U.S. PATENT DOCUMENTS

| | | | | |
|---|---|---|---|---|
| 4,625,964 A | * | 12/1986 | Yamada | 473/373 |
| 4,714,253 A | * | 12/1987 | Nakahara et al. | 473/373 |
| 5,403,010 A | * | 4/1995 | Yabuki et al. | 473/372 |
| 5,553,852 A | * | 9/1996 | Higuchi et al. | 473/373 |
| 5,816,944 A | * | 10/1998 | Asakura et al. | 473/372 |
| 5,957,784 A | | 9/1999 | Asakura et al. | |
| 6,004,226 A | * | 12/1999 | Asakura | 273/DIG. 10 |
| 6,120,391 A | | 9/2000 | Moriyama et al. | |
| 6,241,625 B1 | * | 6/2001 | Yokota et al. | 473/351 |
| 6,287,218 B1 | * | 9/2001 | Ohama | 473/377 |

FOREIGN PATENT DOCUMENTS

| | | |
|---|---|---|
| DE | A2335367 | 9/1999 |
| DE | A2335368 | 9/1999 |
| DE | A2335370 | 9/1999 |
| JP | A10108923 | 4/1998 |
| JP | A10104269 | 4/1999 |
| JP | A11253578 | 9/1999 |
| JP | A11253579 | 9/1999 |
| JP | A11253580 | 9/1999 |

* cited by examiner

*Primary Examiner*—Paul T. Sewell
*Assistant Examiner*—Alvin A. Hunter
(74) *Attorney, Agent, or Firm*—Birch, Stewart, Kolasch & Birch, LLP

(57) ABSTRACT

The present invention provides a three-piece solid golf ball having good shot feel and excellent flight performance. The present invention relates to a three-piece solid golf ball comprising a core, an intermediate layer formed on the core, and a cover covering the intermediate layer, wherein the golf ball is obtained by adjusting a correlation between the amounts of organic sulfide compound, organic peroxide and co-crosslinking agent in a rubber composition for a core, and a correlation between surface hardness of the core, intermediate layer hardness, cover hardness, thickness of the intermediate layer and thickness of the cover, to a specified range.

6 Claims, 1 Drawing Sheet

THREE-PIECE SOLID GOLF BALL

FIELD OF THE INVENTION

The present invention relates to a three-piece solid golf ball. More particularly, it relates to a three-piece solid golf ball having exceptional flight performance and good shot feel at the time of hitting.

BACKGROUND OF THE INVENTION

Many types of golf balls are commercially selling, but they are typically classified into solid golf balls such as two-piece golf ball, three-piece golf ball and the like, and thread wound golf balls. The solid golf balls generally occupy the greater part of the golf ball market, because they inherently have longer flight distance than the thread wound golf balls and have been improved to have soft and good shot feel at the time of hitting as good as the thread wound golf ball. The three-piece golf ball, when compared with the two-piece golf ball, has good shot feel while maintaining exceptional flight performance, because the three-piece golf ball can vary hardness distribution.

The three-piece solid golf balls are obtained by inserting an intermediate layer between the core and the cover layer constituting the two-piece solid golf ball and have been described in Japanese Patent Kokai Publication Nos. 108923/1998, 104269/1999, 253578/1999, 253579/1999, 253580/1999 and the like. In these golf balls, it has been attempted to compromise the balance of flight performance and shot feel at the time of hitting by using thermoplastic resin, such as polyurethane-based thermoplastic elastomer, ionomer resin or mixtures thereof, for the intermediate layer, to adjust a hardness, hardness distribution, deformation amount, specific gravity, elastic modulus of the core, intermediate layer and cover to a proper range.

However, the golf ball having sufficient performances has not been obtained in view of the balance of flight performance and shot feel. Therefore, it is required to provide a golf ball having longer flight distance and better shot feel.

OBJECTS OF THE INVENTION

A main object of the present invention is to provide a three-piece solid golf ball having good shot feel at the time of hitting, while maintaining exceptional flight performance peculiar to solid golf balls.

According to the present invention, the object described above has been accomplished by adjusting a correlation between the amounts of organic sulfide compound, organic peroxide and co-crosslinking agent in a rubber composition for a core, and a correlation between surface hardness of the core, intermediate layer hardness, cover hardness, thickness of the intermediate layer and thickness of the cover, to a specified range, thereby providing a three-piece solid golf ball having good shot feel at the time of hitting, while maintaining exceptional flight performance peculiar to solid golf balls.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
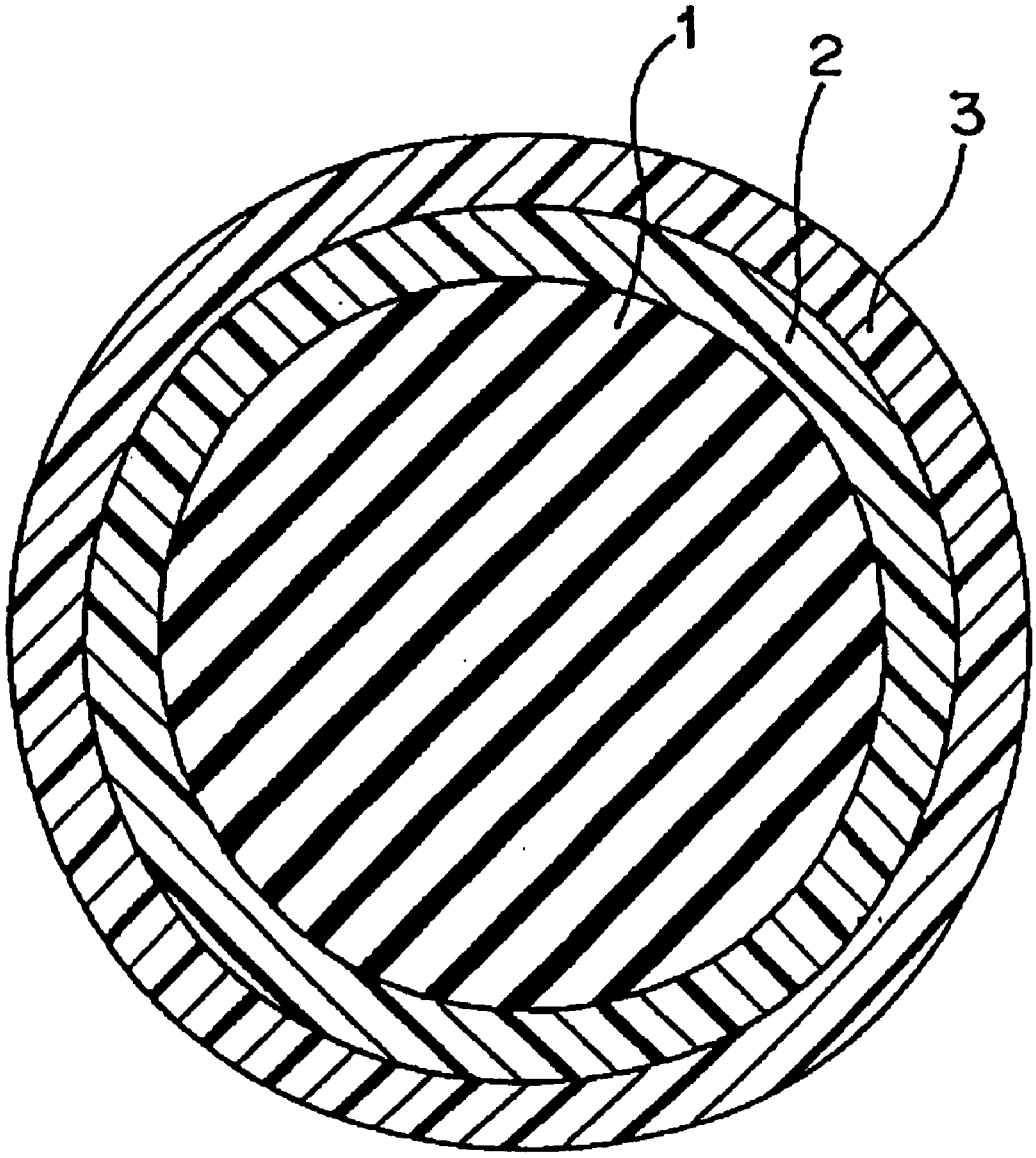
FIG. 1 is a schematic cross section illustrating one embodiment of the golf ball of the present invention.

The present invention provides a three-piece solid golf ball comprising a core, an intermediate layer formed on the core, and a cover covering the intermediate layer, wherein assuming that the core is formed from a rubber composition comprising A parts by weight of organic sulfide compound, B parts by weight of organic oxide and C parts by weight of co-crosslinking agent, based on 100 parts by weight of polybutadiene, a formulation variable (F) represented by the following formula:

$$F=[C(AB)^2]/(A+B)$$

is within the range of 1 to 8, assuming that a surface hardness in JIS-C hardness of the core is represented as K, a hardness in JIS-C hardness of the intermediate layer is represented as L, a hardness in JIS-C hardness of the cover is represented as M, a thickness of the intermediate layer is represented as W (mm) and a thickness of the cover is represented as X (mm), an impact absorption variable (S) represented by the following formula:

$$S=[W(K-L)]/[X(M-K)]$$

is within the range of 0.4 to 1.0, and a hardness difference (K−L) is within the range of 10 to 30.

A rubber composition comprising organic sulfide compound, organic oxide and co-crosslinking agent in polybutadiene has been also used in the rubber composition for the core of the conventional solid golf ball. However, it has been general to employ a given amount of the organic sulfide compound in order to improve the rebound characteristics, and to adjust the amount of the organic oxide and co-crosslinking agent in order to compensate the deterioration of physical properties such as hardness of the core thereby. Therefore it has been conducted to optimize the amount of the each material in order to accomplish higher rebound characteristics. Actually, the variable, which is obtained by using the amount of the each material and represented by the above formula, has been almost out of the scope of the present invention. For example, the amount of the organic sulfide compound is too small as compared with that of the co-crosslinking agent, or the amount of the organic oxide is too large as compared with that of organic sulfide compound. That is, it is possible to improve desired properties such as rebound characteristics by using the organic sulfide compound in the core as compared with using no organic sulfide compound in the core. However, it has been impossible to optimize the performance of the each material used.

In order to put the present invention into a more suitable practical application, it is preferable that the difference (K−J) between the surface hardness of the core (K) and a center hardness in JIS-C hardness of the core (J) be within the range of 2 to 8, the intermediate layer comprise 10 to 100% by weight of polyurethane-based thermoplastic elastomer, based on the total weight of a base resin of the intermediate layer, the ratio (D/E) of a deformation amount of the core (D mm) to that of the intermediate layer (E mm), when applying from an initial load of 98 N to a final load of 1274 N, be within the range of 0.8 to 1.2, and the specific gravity of the intermediate layer be higher than that of the core by not less than 0.07.

DETAILED DESCRIPTION OF THE INVENTION

The three-piece solid golf ball of the present invention will be explained with reference to the accompanying drawing in detail. FIG. 1 is a schematic cross section illustrating one embodiment of the three-piece solid golf ball of the present invention. As shown in FIG. 1, the golf ball of the present invention comprises a core 1, an intermediate layer 2 formed on the core 1, and a cover 3 formed on the intermediate layer 2. The core 1 is obtained by press molding and vulcanizing a rubber composition using a method and condition which are typically used in the manufacture of solid golf ball cores. The rubber composition contains polybutadiene, an organic sulfide compound, a co-crosslinking agent, an organic peroxide, and optionally a filler, an antioxidant and the like.

In the core 1 used in the present invention, it is required that a formulation variable (F) represented by the following formula:

$$F=[C(AB)^2]/(A+B)$$

is within the range of 1 to 8, preferably 1 to 7, more preferably 2 to 7, assuming that the core is formed from a rubber composition comprising A parts by weight of organic sulfide compound, B parts by weight of organic oxide and C parts by weight of co-crosslinking agent, based on 100 parts by weight of polybutadiene. The three components are necessary for cores having high rebound characteristics, but it is very important to optimize the amount of each component in order to accomplishing higher rebound characteristics than them. Therefore it is accomplished by using the variable represented by the above formula, which shows the most suitable formulation balance of the three components. When the variable is smaller than 1, the amount of any of the three components is too small, and the formulation balance is ill. Therefore the shot feel is poor, or good rebound characteristics are not obtained.

The polybutadiene used for the core 1 of the present invention may be one, which has been conventionally used for cores of solid golf balls. Preferred is so-called high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

Examples of organic sulfide compounds include thiophenols, such as pentachlorothiophenol, pentafluorothiophenol, 4-chlorothiophenol, 3-chlorothiophenol, 4-bromothiophenol, 3-bromothiophenol, 4-fluorothiophenol, 4-t-butyl-o-thiophenol, 4-t-butylthiophenol, 2,3-dichlorothiophenol, 2,4-dichlorothiophenol, 2,5-dichlorothiophenol, 2,6-dichlorothiophenol, 3,4-dichlorothiophenol, 3,5-dichlorothiophenol, 2,4,5-trichlorothiophenol, thiosalicylic acid, methylthiosalicylic acid, o-toluenethiol, m-toluenethiol, p-toluenethiol, 3-aminothiophenol, 4-aminothiophenol, 3-methoxythiophenol, 4-methoxythiophenol, 4-mercaptphenyl sulfide, 2-benzamidothiophenol and the like; thiocarboxylic acids, such as thioacetic acid, thiobenzoic acid and the like; disulfides, such as diphenyl disulfide, bis(2-aminophenyl) disulfide, bis(4-aminophenyl) disulfide, bis(4-hydroxyphenyl) disulfide, bis(4-methylphenyl) disulfide, bis(4-t-butylphenyl) disulfide, bis(2-benzamidophenyl) disulfide, dixylyl disulfide, di(o-benzamidophenyl) disulfide, dimorpholino disulfide, bis(4-chlorophenyl) disulfide, bis(3-chlorophenyl) disulfide, bis(2-chlorophenyl) disulfide, bis(4-bromophenyl) disulfide, bis(3-bromophenyl) disulfide, bis(2-bromophenyl) disulfide, bis(2,5-dichlorophenyl) disulfide, bis(3,5-dichlorophenyl) disulfide, bis(2,4,5-trichlorophenyl) disulfide, bis(2-cyanophenyl) disulfide, bis(2-nitrophenyl) disulfide, bis(4-nitrophenyl) disulfide, bis(2,4-dinitrophenyl) disulfide, 2,2-dithio dibenzoic acid, 5,5-dithiobis (2-nitrobenzoic acid), bis (pentafluorophenyl) disulfide, dibenzyl disulfide, di-t-dodecyl disulfide, diallyl disulfide, difurfuryl disulfide, 2,2'-dibenzothiazoryl disulfide, bis(2-naphthyl) disulfide, bis(4-mercaptphenyl) disulfide, 4-(2-benzothiazoryldithio) morpholine, 2,2-dipyridinyl disulfide, 2,2-dithiobis (5-nitropyridine), 2,2-dithiodianiline, 4,4-dithiodianiline, dithiodiglycolic acid, 4,4'-dithiodimorpholine, L-cystine and the like; thiurams, such as tetramethylthiuram disulfide, tetraethylthiuram disulfide, tetrabutylthiuram disulfide, tetramethylthiuram monosulfide, N,N'-dimethyl-N,N'-diphenylthiuram disulfide, dipentamethylenethiuram tetrasulfide and the like; thiazoles, such as 2-mercaptbenzothiazole, 2-mercaptbenzothiazole sodium salt, 2-mercaptbenzothiazole zinc salt, 2-mercaptbenzothiazole dicyclohexylamine salt, 2-(N,N-diethylcarbamylthio)benzothiazole, 2-(4'-morphorinodithio) benzothiazole, 2,5-dimercapt-1,3,4-thiadiazole, Bismuthiol I, Bismuthiol II, 2-amino-5-mercapt-1,3,4-thiadiazole, trithiocyanuric acid and the like; sulfenamides; thioureas; dithiocarbamates; and mixtures thereof. Preferred are thiophenols, disulfides and the like, in view of the technical effect of improving rebound characteristics and its cheapness.

The amount of the organic sulfide compound (A), which is not limited as long as the formulation variable (F) represented by the above formula is within the range described above, is preferably 0.2 to 3.0 parts by weight, more preferably 0.4 to 2.0 parts by weight, based on 100 parts by weight of the polybutadiene. When the amount of the organic sulfide compound (A) is smaller than 0.2 parts by weight, the technical effect accomplished by using the organic. sulfide compound as an additive is not obtained, and the improvement of the performance is not accomplished. On the other hand, when the amount of the organic sulfide compound (A) is larger than 3.0 parts by weight, the organic sulfide compound is excessive, and the performance is degraded on the contrary.

Examples of the organic peroxides include, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide (B), which is not limited as long as the formulation variable (F) represented by the above formula is within the range described above, is preferably 0.3 to 2.0 parts by weight, more preferably 0.3 to 1.5 parts by weight, based on 100 parts by weight of the polybutadiene. When the amount of the organic peroxide (B) is smaller than 0.3 parts by weight, the vulcanization reaction in the core is not sufficiently conducted. On the other hand, when the amount of the organic peroxide (B) is larger than 2.0 parts by weight, the core is comparatively hard, but the rebound characteristics are not improved, or the shot feel is poor.

Examples of the co-crosslinking agents include α,β-unsaturated carboxylic acids having 3 to 8 carbon atoms (e.g. acrylic acid, methacrylic acid, etc.), a mono- or divalent metal salt such as the zinc or magnesium salt thereof and mixtures thereof. The preferred co-crosslinking agent is zinc acrylate because it imparts high rebound characteristics to the resulting golf ball. The amount of the co-crosslinking agent (C), which is not limited as long as the formulation variable (F) represented by the above formula is within the range described above, is preferably from 15 to 30 parts by weight, more preferably from 20 to 28 parts by weight, based on 100 parts by weight of the polybutadiene. When the amount of the co-crosslinking agent is smaller than 15 parts by weight, the vulcanization reaction in the core is not sufficiently conducted, and the rebound characteristics and durability are greatly degraded. On the other hand, when the amount of the co-crosslinking agent (C) is larger than 30 parts by weight, the resulting golf ball is too hard, and the shot feel is poor.

Where appropriate, it is possible to compound a component which is typically used in the manufacture of solid golf ball cores together with the rubber composition; e.g., fillers such as zinc oxide, barium sulfate, calcium carbonate and the like, and other additives such as antioxidants, peptizing agents and the like. If used, preferably the amount of the filler is 5 to 30 parts by weight, the amount of the antioxidant is 0.2 to 5 parts by weight, based on 100 parts by weight of the base rubber.

The core 1 used for the golf ball of the present invention can be obtained by mixing and then press-molding the above rubber composition under applied heat of 130 to 180° C. for 10 to 50 minutes in a mold. In the present invention, the core 1 has a diameter of 32.5 to 37.5 mm, preferably 33.0 to 37.0 mm. When the diameter of the core is smaller than 32.5 mm, the effect of the performance of the core on the performance of the golf ball is small, and the rebound characteristics are degraded, or the shot feel is poor. On the other hand, when the diameter of the core is larger than 37.5 mm, the thickness of the intermediate layer or the cover is small. Therefore the technical effect of impact absorption accomplished by the presence of the intermediate layer or the cover is not sufficiently obtained, and the shot feel is poor and the durability is degraded.

In the golf ball of the present invention, it is required that an impact absorption variable (S) represented by the following formula:

$$S=[W(K-L)]/[X(M-K)]$$

is within the range of 0.4 to 1.0, assuming that a surface hardness in JIS-C hardness of the core 1 is represented as K, a hardness in JIS-C hardness of the intermediate layer 2 is represented as L, a hardness in JIS-C hardness of the cover 3 is represented as M, a thickness of the intermediate layer 2 is represented as W (mm) and a thickness of the cover 3 is represented as X (mm).

It is required to improve the rebound characteristics and restrain the spin amount from excessively increasing in order to improve the flight performance of the golf ball. Therefore it is important for the cover to have high hardness. The technical effect of absorbing impact force at the time of hitting of the cover is obtained by suitably lowering the hardness of the intermediate layer, and good shot feel is obtained by suitably lowering the surface hardness of the core. However, it is required for the core to have sufficient hardness to maintain the desired rebound characteristics of the golf ball. The thickness of the cover and intermediate layer also have an effect on the rebound characteristics and impact absorption performance of the golf ball.

The present inventors noticed that by suitably lowering the intermediate layer hardness, will result in improving the shot feel, and discovered that a correlation between [W(K–L)] and [X(M–K)] is important. The [W(K–L)] represents the extent of lowliness of the stiffness of the intermediate layer to that of the core, and is an index which represents the extent that the intermediate layer has an effect on the shot feel and rebound characteristics. The [X(M–K)] represents the extent of height of the stiffness of the cover to that of the core, and is an index which represents the extent that the cover has an effect on the shot feel and rebound characteristics. In the present invention, a ratio of the two indexes is expressed as an impact absorption variable (S), and it is discovered that the impact force at the time of hitting is absorbed and good shot feel is obtained, while accomplishing the optimized rebound characteristics all over the structure consisting of the core, intermediate layer and cover, by adjusting the variable (S) to a specified range, which is within the range of 0.4 to 1.0. When the impact absorption variable (S) is smaller than 0.4, the ratio of the extent of lowliness of the stiffness of the intermediate layer, [W(K–L)], to that of height of the stiffness of the cover, [X(M–K)], is small. Therefore, the impact absorption effect accomplished by the intermediate layer is not sufficiently obtained, or the stiffness of the cover is too high, and the shot feel is poor. On the other hand, when the impact absorption variable (S) is larger than 1.0, the stiffness of the intermediate layer is too low or the stiffness of the cover is too low, and the impact absorption effect is too large, which degrades the rebound characteristics on the contrary. Therefore the impact absorption variable (S) is within the range of preferably 0.5 to 0.9, more preferably 0.6 to 0.9, most preferably 0.65 to 0.85.

In the present invention, it is required that a difference (K–L) between a surface hardness in JIS-C hardness of the core 1 (K) and a hardness in JIS-C hardness of the intermediate layer (L) is within the range of 10 to 30, preferably 15 to 25, more preferably 17 to 23. When the hardness difference (K–L) is smaller than 10, the impact absorption effect is not sufficiently obtained, and the shot feel is poor. On the other hand, when the hardness difference (K–L) is larger than 30, the impact absorption effect is too large, which degrades the rebound characteristics on the contrary.

In the golf ball of the present invention, since it is necessary for the core to have rebound characteristics and a desired deformation amount, it is desired for the core to have a hardness distribution so that a difference (K–J) between a surface hardness in JIS-C hardness of the core 1 (K) and a center hardness in JIS-C hardness of the core 1 (J) is within the range of 2 to 8, preferably 3 to 7. When the hardness difference (K–J) is smaller than 2, the core has a even hardness difference, and the rebound characteristics are improved, but the deformation amount at the time of hitting of the core is small. Therefore the launch angle is low, which degrades the flight performance, or the shot feel is poor. On the other hand, when the hardness difference is larger than 8, the rebound characteristics of the core are degraded and the surface hardness of the core (K) is large, and the shot feel is poor.

In the golf ball of the present invention, the surface hardness of the core 1 (K), which is not limited as long as the formulation variable (F) represented by the above formula is within the range described above, is preferably 50 to 90, more preferably 60 to 85. When the surface hardness of the core 1 (K) is smaller than 50, the core is too soft, and the rebound characteristics of the resulting golf ball are degraded. On the other hand, when the surface hardness is larger than 90, the shot feel of the resulting golf ball is poor.

In the golf ball of the present invention, the center hardness of the core 1 (J) is within the range of preferably 42 to 88, more preferably 52 to 88. When the center hardness of the core 1 (J) is smaller than 42, the core is too soft, and the rebound characteristics of the resulting golf ball are degraded. On the other hand, when the center hardness is larger than 88, the core is too hard, and the shot feel of the resulting golf ball is poor. The term "center hardness of the core 1" as used herein refers to the hardness, which is determined by cutting the core into two equal parts and then measuring a JIS-C hardness at its center point in section.

In the golf ball of the present invention, a deformation amount of the core (D), when applying from an initial load of 98 N to a final load of 1274 N, is within the range of 3 to 4.5 mm, preferably 3 to 4 mm. When the deformation amount of the core (D) is smaller than 3 mm, the core is too hard, and the shot feel of the resulting golf ball is poor. On the other hand, when the deformation amount is larger than 4.5 mm, the core is too soft, and the rebound characteristics of the resulting golf ball are degraded. In addition, the shot feel is heavy and poor.

In the golf ball of the present invention, a specific gravity of the core 1 is within the range of 1.00 to 1.25, preferably 1.05 to 1.20, more preferably from 1.05 to less than 1.20. When the specific gravity is smaller than 1.00, it is required to compound special materials such as a hollow material together with the core composition, and the rebound characteristics are degraded. On the other hand, when the specific gravity is larger than 1.25, since it is required to adjust the golf ball weight to not more than the standardized value in accordance with the regulations for golf balls, it is required to decrease the specific gravity of the intermediate layer or cover, and the moment of inertia decreases, which reduces the flight distance. The intermediate layer 2 is then formed on the core 1.

The intermediate layer 2 of the golf ball of the present invention, which is not limited, may be formed from ionomer resins or thermoplastic elastomers, or mixtures thereof, as a base resin. Examples of the ionomer resins include a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like. Preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. Examples of the metal ion which neutralizes a portion of carboxylic acid groups of the copolymer or terpolymer include a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1702, Hi-milan 1705, Hi-milan 1706, Hi-milan 1707, Hi-milan 1855 and the like. Examples of the ionomer resins, which are commercially available from Du Pont Co., include Surlyn 8945, Surlyn 9945, Surlyn 6320, Surlyn 8320, Surlyn 9320 and the like. Examples of the ionomer resins, which are commercially available from Exxon Chemical Co., include Iotek 7010, Iotek 8000 and the like. These ionomer resins may be used alone or in combination.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyureithane-based thermoplastic elastomer, which is commercially available from Takeda Badische Urethane Industries, Ltd. under the trade name of "Elastollan" (such as "Elastollan ET880"); polyurethane-based thermoplastic elastomer, which is commercially available from Dainippon Ink & Chemicals Inc., Ltd. under the trade name of "Pandex" (such as "Pandex T-8180"); and the like. Preferred are polyurethane-based thermoplastic elastomers. The amount of the thermoplastic elastomer is preferably 10 to 100%, based on the base resin for the intermediate layer. When the amount is smaller than 10%, the properties so that the shot feel is soft and the rebound characteristics are high is not obtained.

The composition for the intermediate layer used in the present invention may optionally contain fillers, pigments, and the other additives such as an antioxidant, in addition to the ionomer resins or thermoplastic elastomers, or mixtures thereof as main component. Examples of fillers include inorganic filler (such as zinc oxide, barium sulfate, calcium carbonate and the like), high specific gravity metal powder filler (such as tungsten powder, molybdenum powder and the like), and the mixture thereof.

A method of forming the intermediate layer 2 is not specifically limited, but may be a well-known method, which has been conventionally used for forming golf ball cover. For example, there can be used a method comprising molding the intermediate layer composition into a semi-spherical half-shell, covering the core with the two half-shells, followed by pressure molding, or a method comprising injection molding the intermediate layer composition directly on the core to cover it.

In the golf ball of the present invention, the hardness of the intermediate layer 2 in JIS-C hardness (L), which is not limited as long as the impact absorption variable (S) represented by the above formula is within the range described above, is preferably 30 to 80, more preferably 40 to 70. When the hardness of the intermediate layer (L) is smaller than 30, the intermediate layer is too soft, and the rebound characteristics of the resulting golf ball are degraded. On the other hand, when the hardness of the intermediate layer is larger than 80, the impact absorption effect is not sufficiently obtained, and the shot feel of the resulting golf ball is poor. The term "hardness of the intermediate layer" as used herein refers to the surface hardness in JIS-C hardness of the spherical molded article, which is obtained by covering the core 1 with the intermediate layer 2.

In the golf ball of the present invention, the thickness of the intermediate layer 2 (W), which is not limited as long as the impact absorption variable (S) represented by the above formula is within the range described above, is preferably 1.0 to 2.0 mm, more preferably 1.3 to 1.8 mm. When the thickness of the intermediate layer is smaller than 1.0 mm, the intermediate layer is too thin, and the impact absorption effect is not sufficiently obtained. On the other hand, when the thickness of the intermediate layer is larger than 2.0 mm, the rebound characteristics of the resulting golf ball are degraded.

In the golf ball of the present invention, it is desired that a ratio (D/E) of a deformation amount of the core (D) to that of the intermediate layer (E), when applying from an initial load of 98 N to a final load of 1274 N, is within the range of 0.8 to 1.2, preferably 0.8 to 1.1. When the ratio of the deformation amount (D/E) is smaller than 0.8, the intermediate layer is too soft as compared with the core, and the rebound characteristics of the resulting golf ball are degraded; or the core is too hard, and the shot feel is poor; or the deformation amount of the golf ball is too small, and the flight performance is degraded. On the other hand, when the ratio of the deformation amount (D/E) is larger than 1.2, the core is too soft, and the rebound characteristics of the resulting golf ball are degraded; or the intermediate layer is too hard, and the shot feel of the resulting golf ball is poor.

In the golf ball of the present invention, the deformation amount of the intermediate layer (E), when applying from an initial load of 98 N to a final load of 1274 N, is within the range of 3 to 4.5 mm, preferably 3 to 4 mm. When the deformation amount of the intermediate layer (E) is smaller than 3 mm, the intermediate layer is too hard, and the shot feel of the resulting golf ball is poor. On the other hand, when the deformation amount is characteristics of the resulting golf ball are degraded. In addition, the shot feel is heavy and poor. The term "deformation amount of the intermediate layer 2 (E)" as used herein refers to the deformation amount of the spherical molded article, which is obtained by covering the core 1 with the intermediate layer 2.

In the golf ball of the present invention, it is desired that a specific gravity of the intermediate layer 2 is higher than that of the core 1 by not less than 0.07, preferably 0.07 to 2, more preferably 0.1 to 0.18. When the specific gravity of the intermediate layer 2 is higher than that of the core 1, the moment of inertia of the resulting golf ball is large, and a decrement in the spin amount of the golf ball on the fly is small. Therefore the straightness of the golf ball is improved, which improves the flight performance.

In the golf ball of the present invention, a specific gravity of the intermediate layer 2 is within the range of 1.15 to 1.40, preferably 1.20 to 1.35. When the specific gravity is smaller than 1.15, the moment of inertia is small, and the decrement of the back spin amount in the final flight period is large, which reduces the flight distance. On the other hand, when the specific gravity is larger than 1.40, it is required to compound a large amount of high specific gravity fillers together with the intermediate layer composition, which degrades the durability, or rubber content in the golf ball is low, and the rebound characteristics are degraded. The cover 3 is then covered on the intermediate layer 2.

In the cover 3 of the golf ball of the present invention, the same materials as described above for the material used in the intermediate layer 2, which are ionomer resins, thermoplastic resins, or mixtures thereof, can be used. As suitable materials used in the cover 3 of the present invention, the above ionomer resin may be used alone, but the ionomer resin may be suitably used in combination with at least one of the same thermoplastic elastomer used in the intermediate layer 2.

The composition for the cover 3 used in the present invention may optionally contain fillers (such as barium sulfate), pigments (such as titanium dioxide, etc.) and the other additives such as a dispersant, an antioxidant, a UV absorber, a photostabilizer and a fluorescent agent or a fluorescent brightener, etc., in addition to the base resin as a main component, as long as the addition of the additives does not deteriorate the desired performance of the golf ball cover. If used, preferably the amount of the pigment is 0.1 to 5.0 parts by weight, based on 100 parts by weight of the base resin for the cover.

A method of covering the intermediate layer 2 with the cover 3 is not specifically limited, but may be the same method as used in the intermediate layer. In the golf ball of the present invention, the thickness of the cover 3, which is not limited as long as the impact absorption variable (S) represented by the above formula is within the range described above, is preferably 1.5 to 3.0 mm, more preferably 1.8 to 2.7 mm, most preferably 2.1 to 2.5 mm. When the thickness is smaller than 1.5 mm, the cover is too thin, and the durability is degraded and the rebound characteristics are degraded. On the other hand, when the thickness is larger than 3.0 mm, the shot feel is poor.

In the golf ball of the present invention, the difference (M–K) between the hardness of the cover 3 (M) in JIS-C hardness and the surface hardness of the core 1 (K) in JIS-C hardness is within the range of preferably 10 to 35. When the hardness difference is not less than 10, it is possible to keep a balance between the shot feel and the rebound characteristics and improve the durability of the cover 3. Therefor it is desired that the hardness difference (M–K) is within the range of not less than 15, preferably not less than 16. On the other hand, when the hardness difference (M–K) is larger than 35, the cover is too hard, and it is difficult to reach the deformation amount to the intermediate layer or core. Therefore the technical effect of imparting the rebound characteristics by the core or that of improving the shot feel by the intermediate layer may be sufficiently obtained. Therefore it is desired that the hardness difference (M–K) is within the range of not more than 25, preferably not more than 21.

In the golf ball of the present invention, the hardness of the cover 3 in JIS-C hardness (M), which is not limited as long as the impact absorption variable (S) represented by the above formula is within the range described above, is within the range of preferably not less than 90, more preferably 93 to 105. When the hardness of the cover (M) is smaller than 90, the rebound characteristics of are degraded or the spin amount is too large, which reduces the flight distance. The term "hardness of the cover" as used herein refers to the surface hardness in JIS-C hardness of the golf ball, which is obtained by covering the core 1 with the intermediate layer 2 and then with the cover 3.

At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

Production of core

The rubber compositions for the core having the formulation shown in Table 1 were mixed by using a mixing roll, and the mixtures were then press molded at the vulcanization condition shown in Table 4 (Examples) and Table 5 (Comparative Examples) in a mold to obtain cores having a diameter 35.6 mm. The center hardness (J), surface hardness (K), specific gravity and deformation amount of the resulting core were measured, and the results are shown in the same Tables. The hardness difference (K–J) was determined by calculating from the above values of (J) and (K), and the results are shown in the same Tables. The test methods are described later. The formulation variables (F) were determined by calculating from the formulation shown in Table 1, and the results are also shown in Tables 1, 4 and 5.

Formation of intermediate layer

The formulation material for the intermediate layer showed in Table 2 was directly injection-molded on the core to form an intermediate layer having a thickness (W) of 1.4 mm. The hardness (L), specific gravity (Q) and deformation amount (E) of the resulting intermediate layer were measured, and the results are shown in Table 4 (Examples) and Table 5 (Comparative Examples). The hardness difference (K–L), specific gravity difference (Q–P) and ratio of deformation amount (D/E) were determined by calculating from the values of D, E, K, L, Q and P, and the results are also shown in the same Tables. The test methods are described later.

Preparation of cover compositions The formulation materials showed in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 1

| Core composition | | (parts by weight) i | ii | iii | iv | v |
|---|---|---|---|---|---|---|
| BR-11 | *1 | 100 | 100 | 100 | 100 | 100 |
| Zinc acrylate (C) | | 24 | 26 | 29 | 24 | 23 |
| Zinc oxide | | 10 | 9 | 8 | 10 | 10 |
| Dicumyl peroxide (B) | | 0.8 | 1.0 | 0.6 | 2.0 | 0.5 |
| Diphenyl disulfide (A) | | 0.5 | 0.5 | 1.0 | 0.5 | 0.2 |
| Barium sulfate | | 10 | 10 | 10 | 10 | 10 |
| Formulation variable (F) | *7 | 3.0 | 4.3 | 6.5 | 9.6 | 0.3 |

TABLE 2

| Intermediate layer composition | | (parts by weight) a | b |
|---|---|---|---|
| Elastoran ET880 | *2 | 100 | — |
| Surlyn 8320 | *3 | — | 100 |
| Tungsten | | 17 | 35 |

TABLE 3

| Cover composition | | (parts by weight) I | II | III |
|---|---|---|---|---|
| Hi-milan 1605 | *4 | 50 | 30 | 10 |
| Hi-milan 1706 | *5 | 50 | 20 | 5 |
| Hi-milan 1855 | *6 | — | 50 | 85 |
| Titanium dioxide | | 2 | 2 | 2 |
| Barium sulfate | | 2 | 2 | 2 |

1: High-cis polybutadiene (trade name "BR-11") available from JSR Co., Ltd. (Content of 1,4-cis-polybutadiene: 96%)

2: Elastollan ET890 (trade name), polyurethane-based thermoplastic elastomer commercially available from Takeda Badische Urethane Industries, Ltd.

3: Surlyn 8320 (trade name), ethylene-methacrylic acid-n-butyl acrylate terpolymer ionomer resin obtained by neutralizing with sodium ion, manufactured by DuPont Co.

4: Hi-milan 1605 (trade name), ethylene-methacrylic acid copolymer ionomer resin obtained by neutralizing with sodium ion, manufactured by Mitsui Du Pont Polychemical Co., Ltd.

5: Hi-milan 1706 (trade name), ethylene-methacrylic acid copolymer ionomer resin obtained by neutralizing with zinc ion, manufactured by Mitsui Du Pont Polychemical Co., Ltd.

6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.

EXAMPLES 1 TO 5 AND COMPARATIVE EXAMPLES 1 to 3

The cover composition was covered on the intermediate layer by injection molding to form a cover layer having a thickness (X) of 2.2 mm. Then, paint was applied on the surface to produce golf ball having a diameter of 42.8 mm. The hardness of the resulting cover (M), and the coefficient of restitution, flight distance and shot feel of the resulting golf balls were measured or evaluated. The results are shown in Table 4 (Examples) and Table 5 (Comparative Examples). The impact absorption variable (S) was determined by calculating from above results. The test methods are as follows.

(Test Method)

(1) Hardness (i) Core hardness

The surface hardness of the core is determined by measuring JIS-C hardness at the surface of the core. The center hardness of the core is determined by measuring JIS-C hardness at the center point of the core in section, after the core is cut into two equal parts. The JIS-C hardness was measured with a JIS-C hardness meter according to JIS K 6301.

(ii) Intermediate layer hardness

The Intermediate layer hardness is determined by measuring JIS-C hardness at the surface of spherical molded article, which obtained by covering the intermediate layer on the core.

(iii) Cover hardness

After the golf ball is obtained by covering the core with the intermediate layer, and then covering with the cover, the cover hardness is determined by measuring JIS-C hardness at the surface of the golf ball.

(Test Method)

(1) Hardness (i) Hardness of core

The surface hardness of the core is determined by measuring a JIS-C hardness at the surface of the core. The center hardness of the core is determined by cutting the core into two equal parts and then measuring a JIS-C hardness at its center-point in section.

(ii) Hardness of intermediate layer

The hardness of the intermediate layer is determined by measuring a JIS-C hardness at the surface of the spherical molded article, which is obtained by covering the core with the intermediate layer.

(iii) Hardness of cover

The hardness of the cover is determined by measuring a JIS-C hardness at the surface of the golf ball, which is obtained by covering the core with the intermediate layer and then with the cover. The JIS-C hardness was measured with a JIS-C hardness meter according to JIS K 6301.

(2) Deformation amount

The deformation amount of core or intermediate layer was determined by measuring a deformation amount when applying from an initial load of 98 N to a final load of 1274 N on the core or intermediate layer. The deformation amount of the intermediate layer was determined by measuring the deformation amount of spherical molded article, which obtained by covering the intermediate layer on the core.

(3) Flight distance

A No. 1 wood club (W#1, a driver) having metal head was mounted to a swing robot manufactured by True Temper Co. and the resulting golf ball was hit at a head speed of 45 m/sec, the flight distance was measured. As the flight distance, carry that is a distance to the dropping point of the hit golf ball was measured. The measurement was conducted by using 12 golf balls for every sample (n=12), and the average is shown as the result of the golf ball.

(4) Coefficient of restitution

A cylindrical aluminum projectile having weight of 200 g was struck at a speed of 45 m/sec against a golf ball, and the velocity of the projectile and the golf ball before and after the strike were measured using a laser. The coefficient of restitution of the golf ball was calculated from the velocity and the weight of both the projectile and the golf ball. The measurement was conducted by using 12 golf balls for each sample (n=12), with the mean value being taken as the coefficient of restitution of each ball and expressed as an index, with the value of the index in Comparative Example 1 being taken as 100. A higher index corresponded to a higher rebound characteristic, and thus a good result.

(5) Shot feel

The shot feel of the resulting golf ball was evaluated by 10 golfers according to practical hitting test using a No. 1 wood club (W#1, a driver) having metal head. The evaluation criteria are as follows.

(Evaluation criteria)

oo: Not less than 8 golfers out of 10 golfers felt that the golf ball has low impact force at the time of hitting, and has the rebound characteristics and good shot feel.

o: Six to 7 golfers out of 10 golfers felt that the golf ball has low impact force at the time of hitting, and has the rebound characteristics and good shot feel.

Δ: Four to 5 golfers out of 10 golfers felt that the golf ball has low impact force at the time of hitting, and has the rebound characteristics and good shot feel.

x: Not more than 3 golfers out of 10 golfers felt that the golf ball has low impact force at the time of hitting, and has the rebound characteristics and good shot feel.

(Test Result)

TABLE 4

| Test item | Example No. 1 | 2 | 3 | 4 | 5 |
|---|---|---|---|---|---|
| (Core) | | | | | |
| Composition | i | ii | i | iii | i |
| Vulcanization condition: temperature (° C.) × time (min) | | | | | |
| The first stage | | | | | |
| (° C.) | 145 | 145 | 148 | 145 | 155 |
| (min) | 20 | 18 | 18 | 22 | 18 |
| The second stage | | | | | |
| (° C.) | 165 | 165 | 165 | 165 | — |
| (min) | 8 | 8 | 8 | 8 | — |
| Hardness (JIS-C hardness) | | | | | |
| Center hardness (J) | 75 | 74 | 73 | 74 | 70 |
| Surface hardness (K) | 78 | 79 | 80 | 79 | 82 |
| Hardness difference (K-J) | 3 | 5 | 7 | 5 | 12 |

TABLE 4-continued

| Test item | Example No. 1 | 2 | 3 | 4 | 5 |
|---|---|---|---|---|---|
| Specific gravity (P) | 1.14 | 1.14 | 1.14 | 1.14 | 1.14 |
| Deformation amount D (mm) | 3.9 | 3.7 | 4.0 | 3.5 | 4.2 |
| Formulation variable *7 | 3.0 | 4.3 | 3.0 | 6.5 | 3.0 |
| (Intermediate layer) | | | | | |
| Composition | a | a | a | a | a |
| Hardness L (JIS-C) | 58 | 58 | 58 | 58 | 58 |
| Hardness difference (K − L) | 20 | 21 | 22 | 21 | 24 |
| Specific gravity (Q) | 1.28 | 1.28 | 1.28 | 1.28 | 1.28 |
| Specific gravity difference (Q − P) | 0.14 | 0.14 | 0.14 | 0.14 | 0.14 |
| Deformation amount E (mm) | 4.0 | 3.8 | 4.0 | 3.6 | 4.0 |
| Ratio of deformation amount (D/E) | 0.98 | 0.98 | 1.0 | 0.97 | 1.05 |
| Cover composition | I | II | I | I | I |
| Cover hardness M (JIS-C) | 99 | 95 | 99 | 99 | 99 |
| Hardness difference (M − K) | 21 | 16 | 19 | 20 | 17 |
| Impact absorption variable (S) *8 | 0.61 | 0.84 | 0.74 | 0.67 | 0.90 |
| (Physical properties of golf ball) | | | | | |
| Coefficient of restitution | 102.0 | 102.0 | 101.5 | 101.5 | 101.0 |
| Flight distance (m) | 209 | 209 | 210 | 210 | 208 |
| Shot feel | oo | oo | oo | oo | oo |

TABLE 5

| Test item | Comparative Example No. 1 | 2 | 3 |
|---|---|---|---|
| (Core) | | | |
| Composition | iv | v | i |
| Vulcanization condition: temperature (° C.) × time (min) | | | |
| The first stage | | | |
| (° C.) | 143 | 143 | 145 |
| (min) | 18 | 20 | 20 |
| The second stage | | | |
| (° C.) | 165 | 165 | 165 |
| (min) | 8 | 8 | 8 |
| Hardness (JIS-C hardness) | | | |
| Center hardness (J) | 75 | 74 | 75 |
| Surface hardness (K) | 80 | 78 | 78 |
| Hardness difference (K − J) | 5 | 4 | 3 |
| Specific gravity (P) | 1.14 | 1.14 | 1.14 |
| Deformation amount D (mm) | 3.7 | 3.5 | 3.9 |
| Formulation variable *7 | 9.6 | 0.3 | 3.0 |
| (Intermediate layer) | | | |
| Composition | a | a | b |
| Hardness L (JIS-C) | 58 | 58 | 71 |
| Hardness difference (K − L) | 20 | 20 | 7 |
| Specific gravity (Q) | 1.28 | 1.28 | 1.28 |
| Specific gravity difference (Q − P) | 0.14 | 0.14 | 0.14 |
| Deformation amount E (mm) | 3.8 | 3.6 | 3.6 |
| Ratio of deformation amount (D/E) | 0.97 | 0.97 | 1.08 |
| Cover composition | I | III | I |
| Cover hardness M (JIS-C) | 99 | 98 | 99 |

TABLE 5-continued

| Test item | Comparative Example No. 1 | 2 | 3 |
|---|---|---|---|
| Hardness difference (M − K) | 19 | 11 | 21 |
| Impact absorption variable (S) *8 | 0.61 | 1.16 | 0.21 |
| (Physical properties of golf ball) | | | |
| Coefficient of restitution | 100.0 | 98.0 | 101.0 |
| Flight distance (m) | 207 | 206 | 209 |
| Shot feel | ○ | Δ | x |

*7: The formulation variable (F) is represented by the following formula: $F=[C(AB)^2/(A+B)]$, assuming that the core is formed from a rubber composition comprising A parts by weight of organic sulfide compound, B parts by weight of organic oxide and C parts by weight of co-crosslinking agent, based on 100 parts by weight of polybutadiene.

*8: The impact absorption variable (S) is represented by the following formula: $S=[\{W(K-L)\}/\{X(M-K)\}]$, assuming that a surface hardness in JIS-C hardness of the core is represented as K, a hardness in JIS-C hardness of the intermediate layer is represented as L, a hardness in JIS-C hardness of the cover is represented as M, a thickness of the intermediate layer is represented as W (mm) and a thickness of the cover is represented as X (mm).

As is apparent from the results of Tables 4 and 5, the golf balls of the present invention of Examples 1 to 5 as compared with the golf balls of Comparative Examples 1 to 3 have excellent flight performance and good shot feel. The golf ball of Example 5 has larger hardness difference (K–J) than the golf balls of the other Examples, and it has slightly low rebound characteristics and short flight distance.

On the other hand, in the golf ball of Comparative Example 1, the coefficient of restitution is large, which reduces the flight distance, because the amount of the organic peroxide is large and the formulation variable (F) is large. In addition, the shot feel, which the rebound characteristics are low, is slightly heavy, and it is poorer than that of the golf balls of Examples. In the golf ball of Comparative Example 2, the formulation variable (F) is small and the impact absorption variable (S) is large, and the rebound characteristics are very low, which reduces the flight distance. In addition, the shot feel, which the rebound characteristics are low, is heavy and poor. In the golf ball of Comparative Example 3, the difference (K–L) between the surface hardness of the core and the hardness of the intermediate layer is small and the impact absorption variable (S) is small. Therefore, the impact force at the time of hitting is large, and the shot feel is very poor.

What is claimed is:

1. A three-piece solid golf ball comprising a core, an intermediate layer formed on the core, and a cover covering the intermediate layer, wherein the core is formed from a rubber composition comprising A parts by weight of organic sulfide compound, B parts by weight of organic oxide and C parts by weight of co-crosslinking agent, based on 100 parts by weight of polybutadiene, a formulation variable (F) represented by the following formula:

$$F=[C(AB)^2]/(A+B)$$

is within the range of 1 to 8, a surface hardness in JIS-C hardness of the core is represented as K, a hardness in JIS-C hardness of the intermediate layer is represented as L, a hardness in JIS-C of the cover is represented as M, a thickness of the intermediate layer is represented as W (mm) and a thickness of the cover is represented as X (mm), an impact absorption variable (S) represented by the following formula:

$$S=[W(K-I)]/[X(M-K)]$$

is within the range of 0.4 to 1.0, and a hardness difference (K–L) is within the range of 10 to 30, wherein the intermediate layer comprises 10 to 100% by weight of polyurethane-based thermoplastic elastomer, based on the total weight of a base resin of the intermediate layer.

2. A three-piece solid golf ball comprising a core, an intermediate layer formed on the core, and a cover covering the intermediate layer, wherein the core is formed from a rubber composition comprising A parts by weight of organic sulfide compound, B parts by weight of organic oxide and C parts by weight of co-crosslinking agent, based on 100 parts by weight of polybutadiene, a formulation variable (F) represented by the following formula:

$$F=[C(AB)^2]/(A+B)$$

is within the range of 1 to 8, a surface hardness in JIS-C hardness of the core is represented as K, a hardness in JIS-C hardness of the intermediate layer is represented as L, a hardness in JIS-C hardness of the cover is represented as M, a thickness of the intermediate layer is represented as W (mm) and a thickness of the cover is represented as X (mm), an impact absorption variable (S) represented by the following formula:

$$S=[W(K-L)]/[X(M-K)]$$

is within the range of 0.4 to 1.0, and a hardness difference (K–L) is within the range of 10 to 30, a ratio (D/E) of a deformation amount of the core (D mm) to that of the intermediate layer (E mm), when applying from an initial load of 98 N to a final load of 1274 N, is within the range of 0.8 to 1.2.

3. The three-piece solid golf ball according to claim 2, wherein a specific gravity of the intermediate layer is higher than that of the core by not less than 0.07.

4. The three-piece solid golf ball according to claim 2, wherein a difference (K–J) between the surface hardness of the core (K) and a center hardness in JIS-C hardness of the core (J) is within the range of 2 to 8.

5. A three-piece solid golf ball comprising a core, an intermediate layer formed on the core, and a cover covering the intermediate layer, wherein the core is formed from a rubber composition comprising A parts by weight of organic sulfide compound, B parts by weight of organic oxide and C parts by weight of co-crosslinking agent, based on 100 parts by weight of polybutadiene, a formulation variable (F) represented by the following formula:

$$F=[C(AB)^2]/(A+B)$$

is within the range of 1 to 8, a surface hardness in JIS-C hardness of the core is represented as K, a hardness in JIS-C hardness of the intermediate layer is represented as L, a hardness in JIS-C of the cover is represented as M, a hickness of the intermediate layer is represented as W (mm) and a thickness of the cover is represented as X (mm), an impact absorption variable (S) represented by the following formula:

$$S=[W(K-I)]/[X(M-K)]$$

is within the range of 0.4 to 1.0, and a hardness difference (K–L) is within the range of 10 to 30, and wherein a specific gravity of the intermediate layer is higher than that of the core by not less than 0.07.

6. The three-piece solid golf ball according to claim 5, wherein a difference (K–J) between the surface hardness of the core (K) and a center hardness in JIS-C hardness of the core (J) is within the range of 2 to 8.

* * * * *